US009822491B2

(12) United States Patent
Erwe et al.

(10) Patent No.: US 9,822,491 B2
(45) Date of Patent: Nov. 21, 2017

(54) METHOD FOR COVERING A BALLAST BED WITH FOAM IN A RAILWAY TRACK SYSTEM

(71) Applicant: Covestro Deutschland AG, Leverkusen (DE)

(72) Inventors: Torsten Erwe, Odenthal (DE); Thomas Gross, Wermelskirchen (DE); Thomas Kleiner, Odenthal (DE)

(73) Assignee: COVESTRO DEUTSCHLAND AG, Leverkusen (DE)

( * ) Notice: Subject to any disclaimer, the term of this patent is extended or adjusted under 35 U.S.C. 154(b) by 179 days.

(21) Appl. No.: 14/441,015

(22) PCT Filed: Nov. 8, 2013

(86) PCT No.: PCT/EP2013/073361
§ 371 (c)(1),
(2) Date: May 6, 2015

(87) PCT Pub. No.: WO2014/072460
PCT Pub. Date: May 15, 2014

(65) Prior Publication Data

US 2015/0292167 A1 Oct. 15, 2015

(30) Foreign Application Priority Data

Nov. 9, 2012 (EP) ..... 12192106

(51) Int. Cl.
*E01B 27/02* (2006.01)
*E01B 1/00* (2006.01)

(52) U.S. Cl.
CPC ..... *E01B 27/02* (2013.01); *E01B 1/001* (2013.01)

(58) Field of Classification Search
CPC . E01B 1/00; E01B 1/001; E01B 1/002; E01B 1/008; E01B 27/00; E01B 27/02; E01B 27/06; E01B 27/10
See application file for complete search history.

(56) References Cited

U.S. PATENT DOCUMENTS 8,938,887 B2 1/2015 Brüning et al.
2010/0140367 A1* 6/2010 Pawlik ..... E01B 1/001 238/2
2015/0115049 A1 4/2015 Frenzel

FOREIGN PATENT DOCUMENTS

CN 101878339 A 11/2010
DE 19929283 A1 12/2000
(Continued)

OTHER PUBLICATIONS

International Search Report for PCT/EP2013/073361 dated Mar. 17, 2014.

*Primary Examiner* — R. J. McCarry, Jr.
(74) *Attorney, Agent, or Firm* — K&L Gates LLP

(57) ABSTRACT

A method is provided for foaming a ballast bed of a railway track wherein the railway track comprises sleepers positioned on the ballast bed and rails positioned on the sleepers, wherein the rails are covered at least in a partial area along a region of the ballast bed to be foamed, and a foaming agent is introduced into the ballast bed while the rails are covered, wherein the ballast bed has in a sleeper bay defined by two successive sleepers an upper side facing against the gravitational direction, and the ballast bed is heaped up so that the upper side of the ballast bed reaches at least up to an underneath side of the sleeper facing in the gravitational direction.

10 Claims, 6 Drawing Sheets

(56) References Cited

FOREIGN PATENT DOCUMENTS

Figure 1:
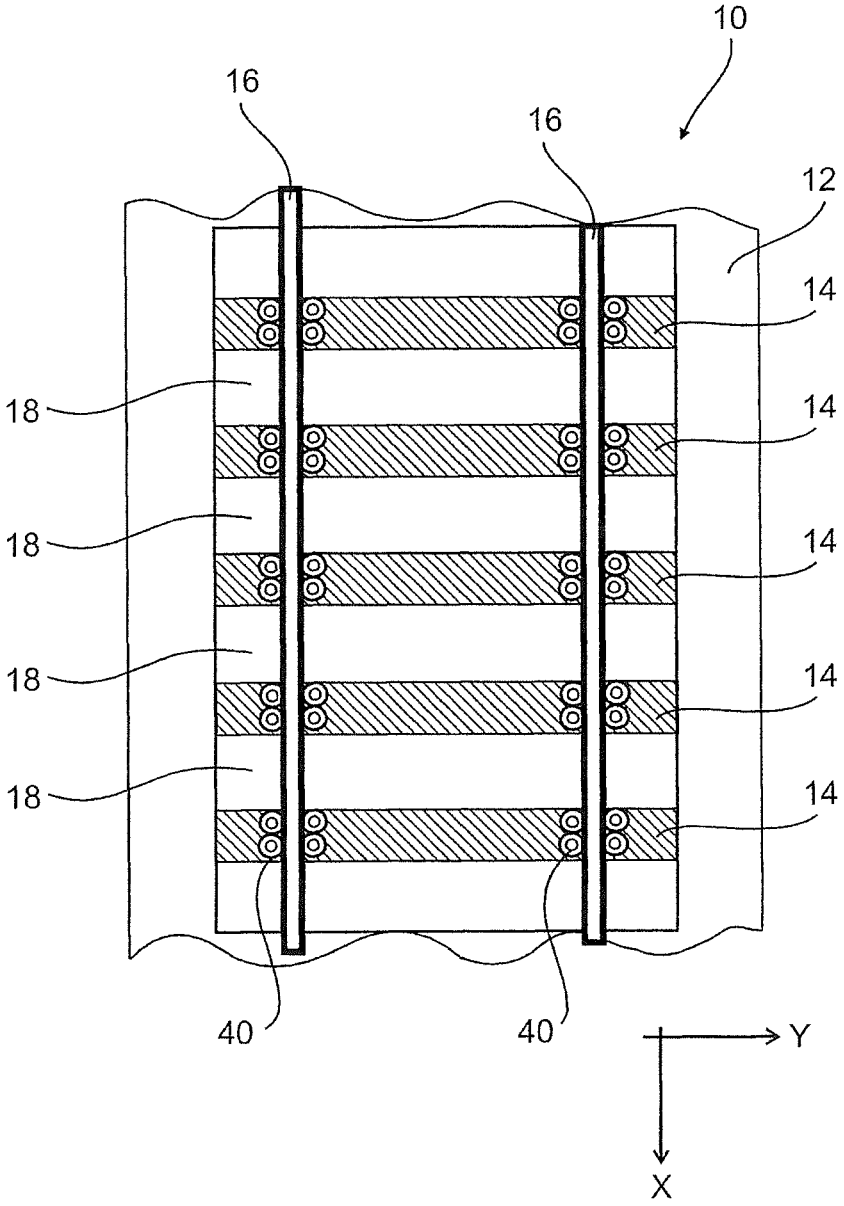

| | | | |
|---|---|---|---|
| EP | 1619305 | A2 | 1/2006 |
| JP | H0718608 | A | 1/1995 |
| WO | WO-2007090901 | A2 | 8/2007 |
| WO | WO-2008128665 | A1 | 10/2008 |
| WO | WO 2009068169 | A1 | 6/2009 |
| WO | WO-2009068169 | A1 | 6/2009 |
| WO | WO-2011110489 | A1 | 9/2011 |
| WO | WO-2011131621 | A1 | 10/2011 |
| WO | WO-2011134967 | A1 | 11/2011 |
| WO | WO-2013034643 | A2 | 3/2013 |

* cited by examiner

METHOD FOR COVERING A BALLAST BED WITH FOAM IN A RAILWAY TRACK SYSTEM

CROSS-REFERENCE TO RELATED APPLICATIONS

This application is a national stage application (under 35 U.S.C. §371) of PCT/EP2013/073361, filed Nov. 8, 2013, which claims benefit of European Application No. 12192106.8, filed Nov. 9, 2012, both of which are incorporated herein by reference in their entirety.

The present invention relates to a method for foaming a ballast bed of a railway track, by means of which the ballast bed of a railway track can be solidified with sufficient elasticity.

In order to stabilize a railway track and to be able to dissipate higher loads, it is known by way of example from EP 1 619 305 B1 to foam up the cavities of a ballast bed of a railway track with polyurethane (PU). For this, the reactants isocyanate, polyol and additives are mixed up as foaming agent and introduced into the cavities of the ballast bed where they react to form polyurethane foam. To this end the ballast bed is partially cleared out ("excavated") in a sleeper bay defined by two successive sleepers wherein by way of example 15 cm to 20 cm of the ballast bed within the sleeper bay are removed. After the foaming the cleared sleeper bay is again filled with ballast up to a nominal operating height of the ballast bed in the sleeper bay during regular rail traffic so that any foam possibly rising up from the depth is covered by the subsequent spoil removal to the nominal operating height. In the case of the nominal operating height of the ballast bed the upper side of the ballast bed is positioned at a height above an underside of the sleepers pointing in the gravitational direction wherein the upper edge of the ballast layer can be arranged close beneath the upper side of the sleeper.

There is a constant need for being able to carry out the construction and/or renovation of a railway track as fast as possible in order to reduce the line stoppage times.

It is the object of the invention to provide a method for foaming a ballast bed of a railway track which enables a rapid construction and/or a rapid renovation of a railway track.

This is achieved according to the invention through the features of claim 1. Preferred configurations of the invention are given in the dependent claims which can represent each individually or in combination one aspect of the invention.

According to the invention a method is provided for foaming a ballast bed of a railway track wherein the railway track has sleepers resting on the ballast bed and rails resting on the sleepers, wherein the rails are covered at least in one partial region along a region of the ballast bed to be foamed, and a foaming agent is introduced into the ballast bed whilst the rails are covered, wherein the ballast bed has in a sleeper bay defined by two successive sleepers an upper side pointing against the gravitational direction and the ballast bed is heaped up so that the upper side of the ballast bed is positioned at a height above an underneath of the sleeper pointing in the gravitational direction.

The upper side of the ballast bed positioned at a height above an underside of the sleeper pointing in the gravitational direction is thus positioned at the normal operating height of the ballast bed. The knowledge is hereby used that it is possible against previous assumption to foam the ballast bed so that the ensuing foam, more particularly of polyurethane (PU), remains inside the ballast bed and does not ooze out from the ballast bed and soil the rails. It is possible by way of example by means of at least one suitably selected catalyst in the reactant mixture of the foaming agent to delay the formation of an expanding agent, more particularly $CO_2$, so far that the substantially fluid foaming agent can flow from the upper side of the ballast bed into the cavities of the ballast bed before a measurable chemical reaction takes place and solidified foam arises. An excavated sleeper bay is not necessary for this so that the reactants and/or the foam can be applied to an unexcavated ballast bed. The working steps of excavation prior to foaming and filling up the ballast bed after foaming can thereby be omitted whereby the total time of a construction work, by way of example for new building and/or renovation of a track section, can be clearly reduced. Since inside the sleeper bay the upper side of the ballast bed is arranged at the normal operating height during the foaming, an increased stability of the ballast bed can be guaranteed during the foaming so that in particular a displacement of the ballast bed by way of example through the temperature expansion effects and/or weathering effects and/or mechanical stresses through a railed vehicle during the foaming can be avoided. Covering the rails can mean that the ballast bed can be sprayed with the foaming agent over a large surface area without thereby soiling the rails. More particularly it can be ensured that no part of the applied foaming agent can pass into contact with a running surface on the rail head of the rail. Also any accidental soiling of the rail through foaming agent which has not run off can thereby be reliably prevented. Since through the covered rails the ballast bed can be sprayed with the foaming agent it is not necessary in order to introduce the foaming agent to insert a distributor pipe into the rail bed. This speeds up the foaming of the ballast bed and enables in particular a continuous working method during foaming of the ballast bed.

The ballast bed is in particular formed by an irregular heaping up of sharp-edged ballast wherein the geometric shape and/or the dimensions of the ballast can range within comparatively wide tolerance regions. The ballast bed is formed in cross section in the travel direction more particularly substantially trapezoidal with laterally dropping slopes. The ballast bed can rest on a substrate ("base grade") wherein in particular a drainage, by way of example a drainage mat, can be provided between the base grade and the ballast bed in order to drain off fluids, more particularly rainwater, away from the ballast bed. The sleepers can rest on the ballast bed and in turn the rails rest on the sleepers at a spacing corresponding to the track width of the intended railway vehicle. The sleepers can be let in slightly into the ballast bed so that not only the underneath side but also the side faces of the sleepers can stand in contact with the ballast bed. The rails can be fastened to the sleepers by means of fastening means, more particularly Vossloh clamps. The foaming agent is more particularly a mixture of a reactive mixture, which contains in particular isocyanate and polyol, wherein the mixture can contain additionally at least one catalyst and/or additional expanding agent. The expanding agent, more particularly $CO_2$, is preferably produced through a chemical reaction of the foaming agent. The foaming agent can furthermore contain additives which by way of example improve the durability and/or manageability. More particularly the foaming agent is environmentally compatible, preferably substantially free of amines.

More particularly the vertical positioning of the upper side of the ballast bed in the sleeper bay corresponds substantially to the nominal operating height of the ballast bed in the sleeper bay during the regular rail traffic operation. The ballast bed is thereby already in its designated end position inside the sleeper bay during the foaming so that a previous digging out of the sleeper bay and/or a subsequent filling of the sleeper bay with ballast can be completely omitted. The operating height of the ballast bed can reach in particular up to an underneath side of the rail pointing in the gravitational direction or have a distance d from the underneath side of the rail of 0.5 cm≤d≤10 cm.

The foaming agent is preferably applied from an outlet at a level above a running surface of the rail wherein in particular the level is kept substantially constant for foaming two successive sleeper bays. The foaming agent can thereby be applied to the ballast bed, by way of example by pouring and/or spraying, with and/or without a displacement of the at least one outlet relative to a railway vehicle having the at least one outlet. The outlet can be formed movable in a longitudinal direction and/or a transverse direction relative to a railway vehicle having the outlet, wherein the at least one outlet can be formed movable in the transverse direction beyond one end of the sleepers. The structural design of a discharge device having the at least one outlet for discharging the foaming agent can thereby be simplified. More particularly it is possible to form the outlet by a short pipe member or nozzle member connected to a mixing head for mixing the components of the foaming agent so that longer length stretches for discharging the foaming agent are avoided. The risk of a blockage occurring in the outlet is thereby reduced.

It is particularly preferred if at least the rail and/or the sleeper is covered with at least one cover which is aligned inclined relative to the gravitational direction. The cover can thereby cover one or both rails and/or cover one or both sleepers which adjoin one sleeper bay. The cover can be designed by way of example in the form of a covering plate. The foaming agent can run down on the cover and pass away from the rail and/or the sleeper to the ballast bed. Soiling of the rail and/or the sleeper is thereby avoided wherein the foaming agent which would otherwise strike the rail and/or the sleeper can be used for foaming the ballast bed, more particularly close to the rail, preferably underneath the rail. The foaming agent can thereby be applied substantially uniformly in particular on the railway track, wherein it can nevertheless be ensured that sufficient foaming agent for foaming the ballast bed can be introduced into the area of the ballast bed underneath the rail which is difficult to access.

More particularly the at least one rail and/or the sleeper is covered by a covering hood wherein the covering hood has a first cover, a cover plate, and a second cover which is connected at an angle to the first cover. The covering hood can cover the rail and/or the sleeper similar to a pitched roof, wherein it is also possible that the first cover is connected to the second cover indirectly via a substantially horizontally aligned intermediate member in order to reduce the vertical extension of the covering hood. The cover and/or the covering hood can be formed like a frame wherein the frame-like cover and/or covering hood can cover the rails and the sleepers of a sleeper bay on which the foaming agent is to be applied. More particularly it is possible to prevent the cover plates from slipping sideways away from the rail. The covers can be set down on the ballast bed and/or clamp the rail between the two cover plates as a result of their inherent weight. The covering hood can thereby have an adequate stability so that the pressure of the foaming agent striking the covering hood does not press the covering hood away from the rail.

The cover and/or the covering hood preferably has at least one guide for continuously entraining the covering hood and/or the cover on the rail.

The guide can be a rail-borne guide which allows an accurate positioning of the covering hood and/or the covers relative to the rails. The guide can be designed by way of example in the form of a frame for setting down on the rails, and can have rollers, wheels, and/or sliding shoes for contacting the rail or rails. The positioning of the cover and/or the covering hood in the travel direction can thereby be predefined. It is furthermore possible that the foaming agent is discharged inclined in the travel direction so that the foaming agent strikes the cover and/or the covering hood with a force component in the travel direction or against the travel direction and the cover and/or the covering hood can thereby be movable in a longitudinal direction. The cover and/or the covering hood can be designed like a frame wherein the frame-like covering hood can be formed from covers and at least one intermediate member, by way of example as an open frame. The frame-like cover and/or covering hood can thereby cover the rails and the sleepers of a sleeper bay on which the foaming agent is to be applied. The guide can enable a continuous entrainment of the cover and/or the covering hood along the rails whereby a continuous application of the reaction mixture can become possible.

Particularly preferably the cover and/or the covering hood has a repellent means for repelling the foaming agent wherein the repellent means is designed in particular as a coating wherein several tear-off foils arranged one above the other and each having a coating which forms the repellent means are provided. The repellent means can have by way of example a micro structure designed similar to the lotus plant whereby a lotus-type repellent effect is provided. More particularly several tear-off foils are provided which are connected to one another by a removable adhesive layer and which are each provided with the repellent means. After one use the topmost tear-off foil can be torn off so that the tear-off foil lying underneath or the repellent means lying underneath can be utilized for a further use. The repellent means can prevent the foaming agent from adhering to the cover and/or the covering hood so that the foaming agent can be directed rapidly to the ballast bed, preferably before the foaming agent starts to foam. More particularly the cover and/or the covering hood can thereby also be protected from becoming soiled by the foaming agent. The cover and/or the covering hood can thereby be repeatedly reused. By way of example it is possible to initially cover a rail with the cover and/or the covering hood. After the foaming agent has been applied in this region the cover and/or the covering hood can be taken up again and used to cover another region of the rail, whilst foaming agent is applied still in a region following the previous region, for which another set of covers and/or covering hoods is used. A long stretch of the rails can thereby be covered during foaming with a low material use of covers and/or covering hoods. In addition the cover plate can be cleaned by compressed air, more particularly by a pressurized blast of compressed air, of any reaction mixture which may still be adhering.

In particular the foaming agent is introduced so far into the ballast bed that after the foaming of the foaming agent the ensuing foam remains substantially completely underneath the upper side of the ballast bed in the sleeper bay. By way of example by means of suitably selected catalysts in the foaming agent the start and the end of the foaming process can be adjusted accordingly so that a desired rising height of the ensuing foam can be provided so that the foam does not extend over the top side of the ballast bed. An unnecessary material use of the foaming agent is thereby avoided.

Particularly preferably the discharge of the foaming agent can be interrupted in the event of passing over a rail and/or from one sleeper bay to a following sleeper bay. An interruption in the application of the foaming agent can be provided by way of example when applying the foaming agent without a cover and/or covering hood. The application of the foaming agent can thereby be interrupted when the outlet is guided over a rail and/or sleeper. Through the temporary interruption in the application it can be avoided that the foaming agent wets the rail, more particularly the top side of the rail, and/or the sleeper between two successive sleeper bays. An unnecessary material use of the foaming agent is thereby avoided. More particularly the discharge of the foaming agent takes place through a to and fro movement of an outlet in a transverse and/or longitudinal direction for applying the foaming agent more particularly transversely to the travel direction of the railway tracks, wherein the discharge of the foaming agent can be interrupted in the region of the rail. At one end of the sleeper the outlet can be guided U-shaped round the sleeper end whereby the embedding of the sleepers in the ballast bed can be improved. The risk of soiling the rail is thereby reduced. Furthermore the cover and/or the covering hood is brought into contact with a lower mass of foaming agent whereby the service lives of the covers and/or covering hoods are increased.

Particularly preferably the foaming agent is supplied by a railway vehicle moving on the rails of the railway track whereby the railway vehicle moves forward substantially continuously, more particularly at a constant driving speed, for foaming the ballast bed of the railway track. The at least one outlet can be moved, independently of a movement of the railway vehicle, into the longitudinal direction and the transverse direction in relation to the continuing motion direction of the railway vehicle. The at least one outlet can be moved during movement of the railway vehicle substantially parallel to the sleepers, more particularly through a simultaneous movement in the longitudinal direction and transverse direction matched to the speed of the railway vehicle. A constant travelling speed of the railway vehicle during the application of the foam mixture can thereby be enabled. A discontinuous method of operation during foaming of the ballast bed is thereby avoided so that a rapid and uncomplicated method of operation becomes possible. More particularly it is not necessary to stop and start the railway vehicle again and again.

Figure 2:
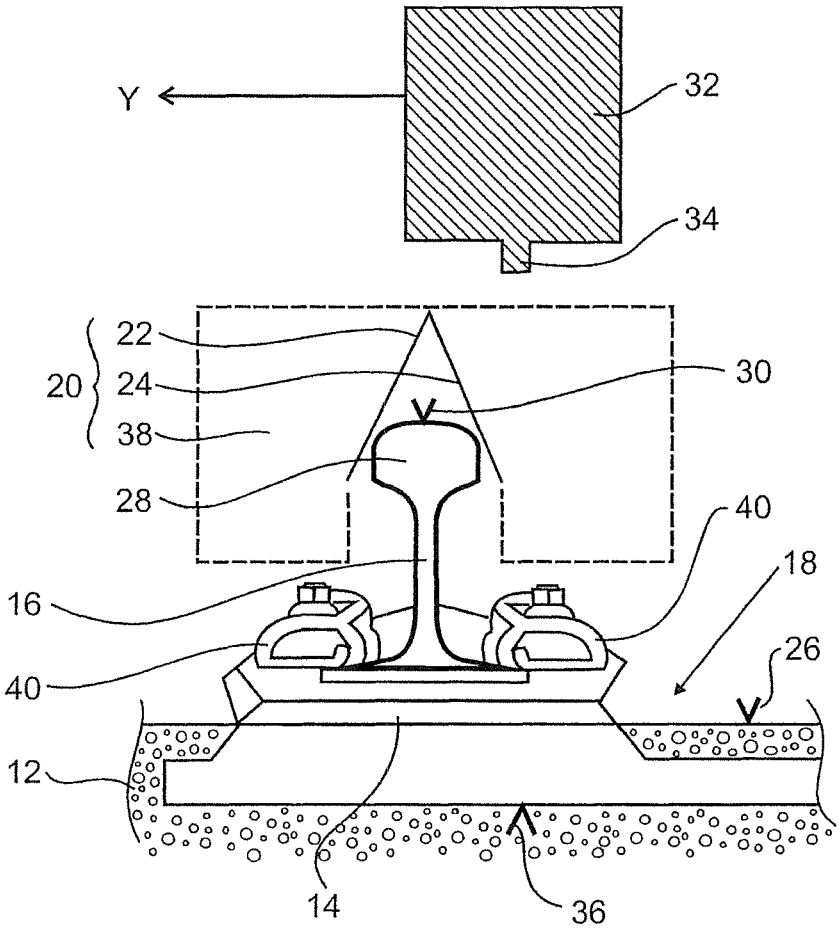
Figure 3:
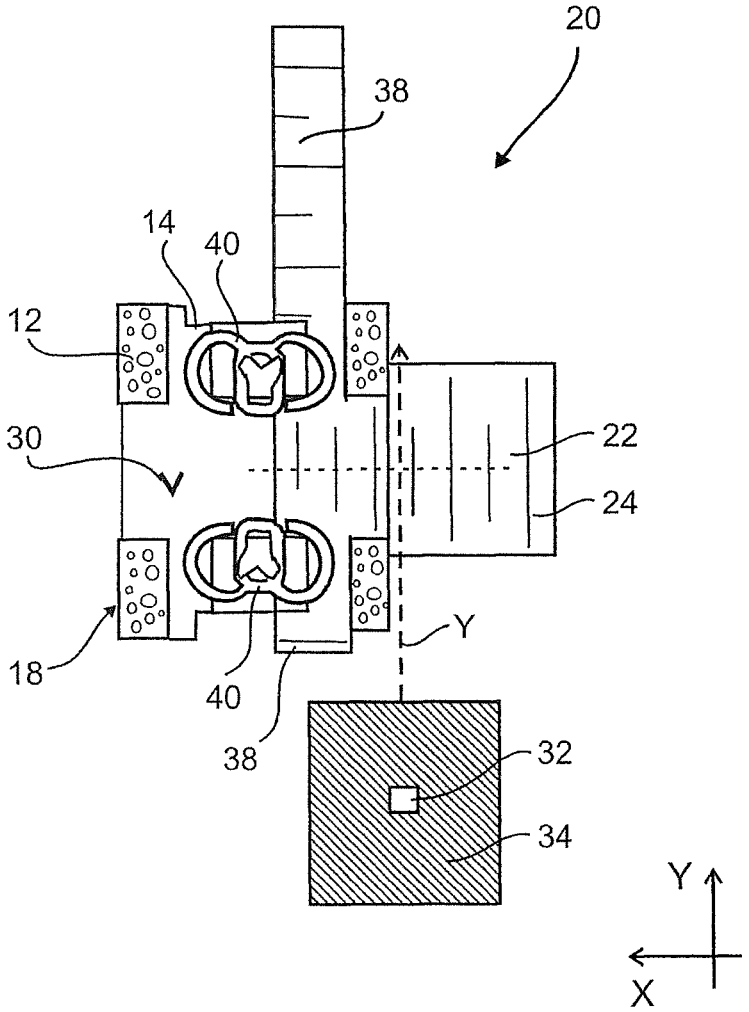
Figure 4:
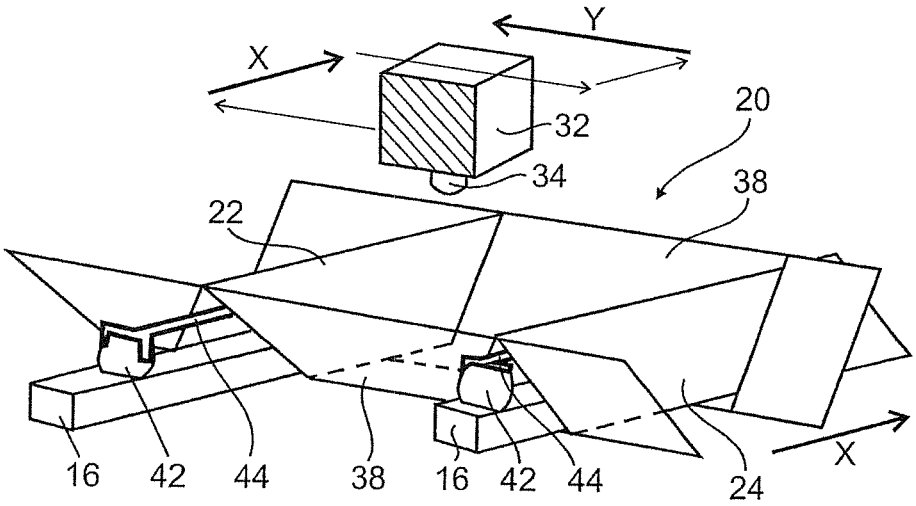
Figure 5A:
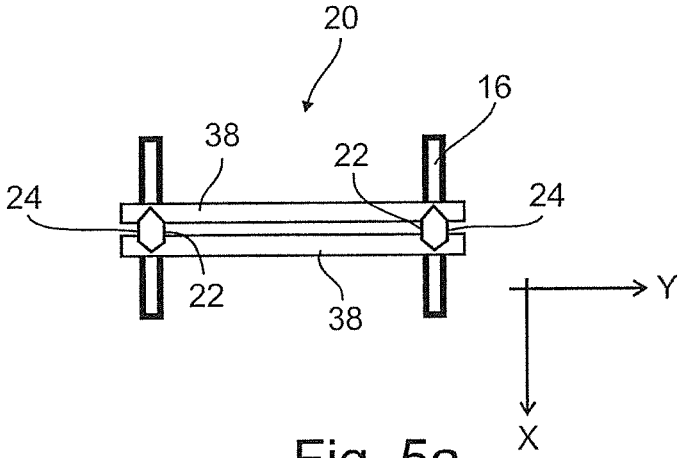
Figure 5B:
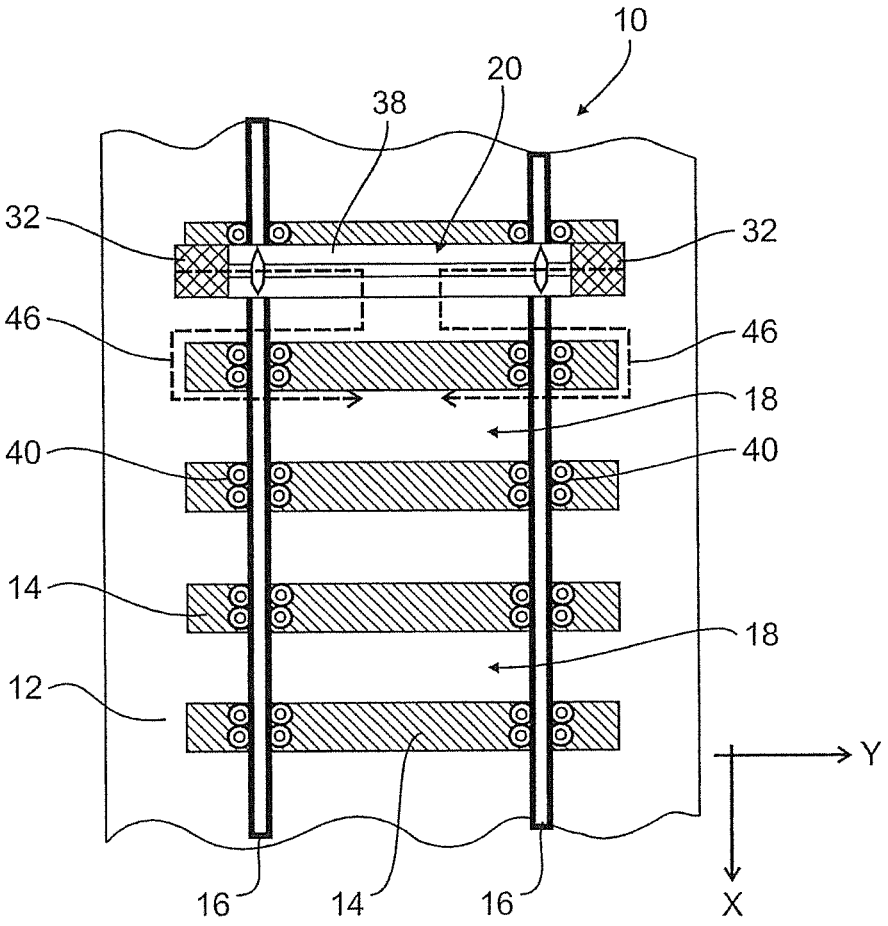
Figure 6:
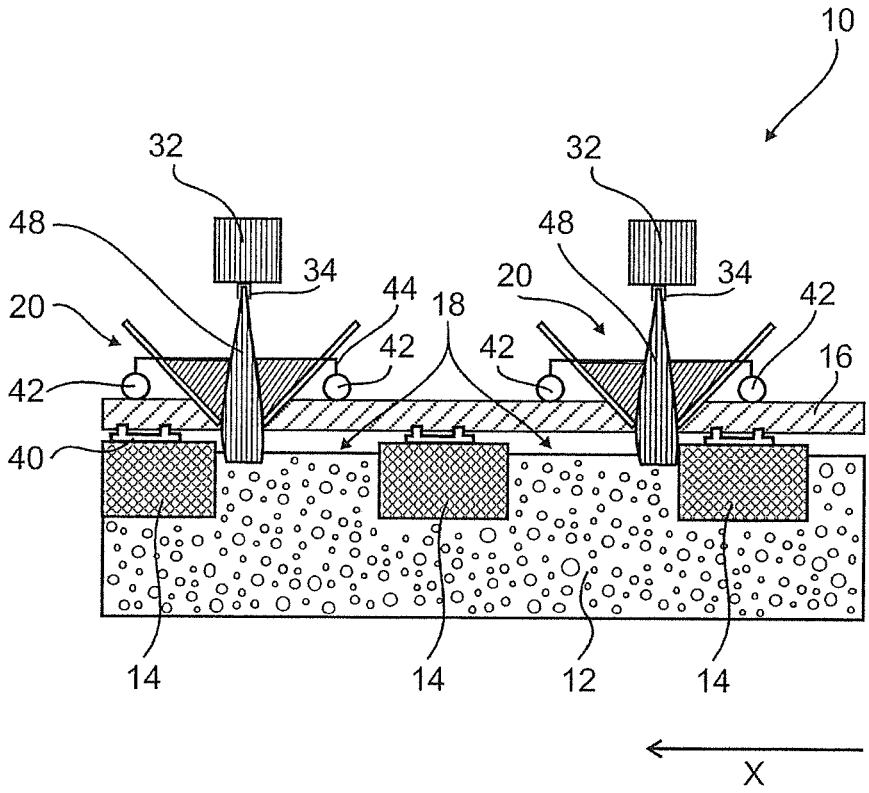

The invention will now be explained by way of example with reference to the accompanying drawings using a preferred embodiment, wherein the features explained below can represent one aspect of the invention each individually and also in combination. The drawings show:

FIG. 1: a diagrammatic plan view of a railway track;

FIG. 2: a diagrammatic sectional view of a detail of the railway track during foaming;

FIG. 3: a diagrammatic plan view of the railway track of FIG. 2;

FIG. 4: a perspective view of a continuously entrainable cover;

FIG. 5*a*: a diagrammatic plan view of a cover;

FIG. 5*b*: a diagrammatic plan view of a railway track with a cover;

FIG. 6: a side view of a railway track with two covers.

The railway track 10 illustrated in FIG. 1 has a ballast bed 12 on which several sleepers 14 are placed. The sleepers 14 support two rails 16 which are aligned in the travel direction, in the longitudinal direction X, and which are arranged spaced relative to one another corresponding to the intended track width. A sleeper bay 18 is formed between two sleepers 14 and the two rails 16.

As shown in FIG. 2, the rail 16 can be covered with a covering hood 20 during foaming of the ballast bed 12. The covering hood 20 has in the illustrated embodiment a first cover 22 and a second cover 24 which are connected to one another in the manner of a pitched roof. The covering hood 20 has at least one intermediate member 38 which is arranged on the covers 22, 24 in the transverse direction Y, substantially at right angles to the rail 16. The intermediate member 38 can be designed in the form of a one-sided cover with an incline towards the sleeper bay. The intermediate member 38 can be designed in the form of a roof with two inclines. In the illustrated embodiment the covering hood 20 is spaced from an upper side 26 of the ballast bed 12 in the region of the sleeper bay 18. The covering hood 20 can be centred by the cover 22, 24, which laterally adjoins a rail head 28 of the rail 16, and can be clamped with the rail 16 by its inherent weight. A running surface 30 of the rail 16 formed by the rail head 28 and facing against the gravitational direction is thereby covered substantially entirely. The sleeper 14 is covered by the intermediate member 38. When a foaming agent is applied from a mixer head 32 which is provided in a transverse direction Y via an outlet 34 at a level which in the gravitational direction is above the running surface 30 of the rail 16 and where applicable above the covering hood 20, the substantially fluid foaming agent can flow away from the running surface 30 of the rail 16 and the sleeper 14 at the covers 22, 24 of the covering hood 20 and the intermediate member 38 and instead pass to the ballast bed 12. It is hereby not necessary for the sleeper bay 18 to be dug out so that the upper side 26 of the ballast bed 12 can already correspond in the region of the sleeper bay 18 to the nominal operating height of the ballast bed 12 during the regular rail operation. The upper side 26 of the ballast bed 12 in the region of the sleeper bay 18 can thereby be located at a level which is provided in the gravitational direction above an underneath side 36 of the sleeper 14 facing the base grade.

As shown in FIG. 3, the covering hood 20 has at least one intermediate member 38 arranged transversely to the travel direction. The intermediate members 38 can be arranged on the covers 22, 24 in the travel direction or opposite the travel direction and can protect at least in part the sleeper (not shown) and at least in part a fastening member 40, by way of example in the form of a Vossloh clamp, against soiling by the foaming agent. In the event of movement of the mixer head 34 in the transverse direction Y the rail 16 can be protected against soiling by the covers 22, 24.

The covering hood 20 in FIG. 4 has covers 22, 24 and two intermediate members 38 wherein the intermediate members 38 have at least the width of the sleepers. The covering hood 20 has a rail-related guide 42 for continuously entraining the covering hood 20 in the form of rollers which roll along the rails 16 in the longitudinal direction X. The rollers 42 are connected via a rod linkage 44 on which the covering hood 20 is positioned. The mixer head 32 can be moved both in the transverse direction and also in the longitudinal direction X relative to the railway vehicle (not shown) and/or the covering hood 20. With a continuous movement of the railway vehicle and/or the covering hood 20 the mixer head 32 can thereby be moved substantially parallel to the sleepers 14 in order to apply the foaming agent into the sleeper bay 18. The mixer head 32 can execute a pendulum movement in the transverse direction Y about a rail 16 wherein the pendulum movement can move round the sleeper 14 at the end.

FIG. 5*a* shows a covering hood 20 arranged on two rails 16 and having the first and second covers 22, 24 and two intermediate members 38. The covering hood 20 is shown in FIG. 5*b* on a railway track 10, wherein two mixer heads 32 are provided, one for each rail 16. The mixer heads 32 can be moved independently of one another both in the longitudinal direction X and also in the transverse direction Y. With a continuous movement of the covering hood 20 in the longitudinal direction X the mixer heads 32 can each swing in a pendulum movement about a rail 16 and thereby follow a U-shaped travel path 46 with components in the longitudinal direction X and transverse direction Y, wherein the travel path 46 can be guided each time around the outside end of the sleepers 14. The foaming agent can be introduced into the ballast bed 12 mainly in the region of the rails 16.

An arrangement of two covering hoods 20 which can each have one or two mixer heads 32 is shown in FIG. 6. The foaming agent 48 can be applied onto the ballast bed 12, more particularly in the sleeper bays 18, through the outlets 34 of the mixer heads 32. The covering hoods 20 are continuously movable along the rails 16 in the longitudinal direction X by guides 42. The foaming agent 48 can thereby be dispensed continuously wherein the rails 16 and the sleepers 14 are protected by the covering hoods 20 from becoming soiled.

The invention claimed is:

1. A method for foaming a ballast bed of a railway track, wherein the railway track comprises sleepers placed on the ballast bed, and rails, placed on the sleepers, wherein the rails are covered with at least one cover at least along one region of the ballast bed which is to be foamed, and a foaming agent is introduced into the ballast bed whilst the rails are covered, wherein the ballast bed has in a sleeper bay defined by two successive sleepers an upper side facing against the gravitational direction, and the ballast bed is heaped up so that the upper side of the ballast bed is positioned at a level above an underside of the sleeper facing in the gravitational direction, wherein the foaming agent is applied from an outlet at a level above a running surface of the rail wherein the level is maintained substantially constant for foaming two successive sleeper bays.

2. The method according to claim 1 in which the level of the upper side of the ballast bed in the sleeper bay corresponds substantially to the nominal operating level of the ballast bed in the sleeper bay during regular rail traffic operation.

3. The method according to claim 1 wherein at least the rail and/or the sleeper is covered with at least one cover aligned inclined relative to the gravitational direction.

4. The method according to claim 3 wherein the cover and/or the covering hood has at least one guide for continuously entraining the covering hood and/or the cover on the rail.

5. The method according to claim 3 wherein the cover plate and/or the covering hood has a repellent means for repelling foaming agent.

6. The method according to claim 5 wherein the repellent means is more particularly designed as a coating.

7. The method according to claim 1 wherein at least the rail and/or the sleeper is covered by a covering hood wherein the covering hood comprises a first cover and a second cover connected at an angle to the first cover.

8. The method according to claim 1 wherein the foaming agent is introduced so far into the ballast bed that after the foaming of the foaming agent the resulting foam remains in the sleeper bay substantially completely below the upper side of the ballast bed.

9. The method according to claim 1 wherein the dispensing of the foaming agent can be interrupted when passing over a rail and/or from one sleeper bay to a following sleeper bay.

10. The method according to claim 1 wherein the foaming agent is applied by a railway vehicle travelling on the rails of the railway track, wherein the railway vehicle for foaming the ballast bed of the railway track moves forwards substantially continuously, more particularly at a constant travelling speed.

* * * * *